US011021846B2

(12) United States Patent
Cotter et al.

(10) Patent No.: US 11,021,846 B2
(45) Date of Patent: Jun. 1, 2021

(54) ARC MELTED GLASS PILES FOR STRUCTURAL FOUNDATIONS AND METHOD OF USE

(71) Applicant: University of South Florida, Tampa, FL (US)

(72) Inventors: John Michael Cotter, Dade City, FL (US); Rasim O. Guldiken, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 16/570,420

(22) Filed: Sep. 13, 2019

(65) Prior Publication Data

US 2020/0087881 A1 Mar. 19, 2020

Related U.S. Application Data

(60) Provisional application No. 62/731,891, filed on Sep. 15, 2018.

(51) Int. Cl.

| | |
|---|---|
| ***E02D 5/38*** | (2006.01) |
| ***E02D 5/66*** | (2006.01) |
| *E02D 27/32* | (2006.01) |

(52) U.S. Cl.

CPC ..... *E02D 5/38* (2013.01); *E02D 5/665* (2013.01); *E02D 27/32* (2013.01)

(58) Field of Classification Search

None

See application file for complete search history.

(56) References Cited

U.S. PATENT DOCUMENTS

| | | | |
|---|---|---|---|
| 762,270 | A | 6/1904 | Benjamin |
| 2,692,296 | A | 10/1954 | De Piolenc et al. |

(Continued)

FOREIGN PATENT DOCUMENTS

| | | |
|---|---|---|
| CN | 106368207 | 2/2017 |
| JP | H04254694 | 9/1992 |

(Continued)

OTHER PUBLICATIONS

Rolland, et al., Mapping Organizational Units in the State: Challenges and Classifications, International Journal of Public Administration, 33: 463-473, 2010.

(Continued)

*Primary Examiner* — Sean D Andrish

(74) *Attorney, Agent, or Firm* — Meunier Carlin & Curfman LLC

(57) ABSTRACT

A system for forming a piling structure includes a hollow casing, a control assembly positioned proximately to the hollow casing, and a pivoting support device connected to the control assembly. A pivoting electrode is connected to the pivoting support device and configured to extend into the hollow casing. A second electrode is connected to the control assembly and extends into the hollow casing within the range of motion of the pivoting electrode. An electric power source is connected to the pivoting electrode and the second electrode, wherein charge on the electrodes produces a current arc between the pivoting electrode and the second electrode. A lift mechanism is positioned proximately to the hollow casing to control the electrodes position within the hollow casing.

22 Claims, 7 Drawing Sheets

(56) References Cited

U.S. PATENT DOCUMENTS

| | | | | |
|---|---|---|---|---|
| 4,037,043 | A | 7/1977 | Segsworth | |
| 4,230,425 | A | 10/1980 | Gusev et al. | |
| 4,538,042 | A | 8/1985 | Tanaka et al. | |
| 4,867,609 | A | 9/1989 | Grosman | |
| 4,957,393 | A | 9/1990 | Buelt et al. | |
| 5,476,992 | A | 12/1995 | Ho et al. | |
| 6,120,028 | A | 9/2000 | Boyer | |
| 6,120,430 | A * | 9/2000 | Hansen | B09B 3/00 405/128.65 |
| 2008/0205993 | A1 | 8/2008 | Wissmann et al. | |
| 2009/0035070 | A1 | 2/2009 | Kwon | |
| 2012/0151966 | A1 | 6/2012 | Sakamoto et al. | |

FOREIGN PATENT DOCUMENTS

| | | |
|---|---|---|
| JP | 2003335532 | 11/2003 |
| WO | 2008088172 | 7/2008 |

OTHER PUBLICATIONS

Shilong Jia et al. (2018). Research on the Properties of the Waste Glass Concrete Composite Foundation. IOP Conference Series: Earth and Environmental Science. 113. 012098. 10.1088/1755-1315/113/1/012098.

Henry, Karen S., and Susan Hunnewell Morin. "Frost susceptibility of crushed glass used as construction aggregate." Journal of cold regions engineering 11.4 (1997): 326-333.

International Search Report and Written Opinion issued for Application No. PCT/US2019/051020, dated Dec. 11, 2019.

* cited by examiner

ARC MELTED GLASS PILES FOR STRUCTURAL FOUNDATIONS AND METHOD OF USE

CROSS REFERENCE TO RELATED APPLICATIONS

This application claims priority to, and the benefit of, U.S. Provisional Patent Application Ser. No. 62/731,891 filed on Sep. 15, 2018, which is incorporated by reference as if set forth fully herein.

STATEMENT REGARDING FEDERALLY SPONSORED RESEARCH

No federally sponsored research funds have been used for this work.

FIELD

The technology described in this disclosure relates to pile formations used as structural foundation supports for building construction and other loads on soil substrates.

BACKGROUND

The broader societal need for glass fillers in structural pilings is not just a reduction in cost of pilings. Pilings can be substantial costs as some are as large as 24" diameters and up to 150' long. These are substantial components of foundations utilized for larger structures. A reduction in building costs would have far reaching effects throughout the country. Reducing building costs would put many projects that would have otherwise been neglected into reach, such as infrastructure upgrades. In fact, the current U.S. President has plans to increase infrastructure spending to $1T (whitehouse.gov). This is substantial especially considering the scale of projects. Infrastructure typically requires larger foundations that residential construction, meaning that most of these projects will require some type of pile foundation (bridges, for example, require larger foundations due to the high loading of the structures).

Prior art pilings include those made of steel, timber, and concrete summarized below.

Steel: These are used by driving the piles into soil. These cannot be used in soils with high moisture content as the steel will rust and deteriorate.

Timber: These have select uses. In locations were timber is very low cost, these can be economical, but they are more typically used in select locations in which the foundations are continually wet. Timber will not rot if continually wet or continually dry.

Concrete:

Precast: Increased cost due to shipping of materials. Must be driven in place. Design must balance drivability and resistance; tapered piles drive easily into soil but do not transfer load from the bottom point to the soil efficiently. Preferred for frictional piles.

In-Situ Cast: Requires large bore holes for strength. Requires carefully installed rebar cages to prevent shrinkage/expansion cracking. Rebar can rust just as steel piles as concrete is a porous material. Increased cost due to having to ship materials. Added difficulty from having a time-sensitive material to install.

Installation methods for foundational piles include driven piles often made of steel, timber, or precast concrete. Other piles, particularly prior art piles made of concrete, may be cast in place.

As shown in FIGS. 1A, 1B, and 2, loading methods for the piles include end-bearing piles and frictional piles.

FIGS. 1A and 1B show two piles. The pile 20 of FIG. 1A is transferring load 10 to a rocky layer 19 below, as indicated by the arrow 22 at the bottom of the image. The pile of FIG. 1B is transferring load 10, via friction, to a clay layer 17 (which is squeezing the pile, as indicated by the horizontal, black arrows 25) as well as a stronger sand layer 23 (indicated by a smaller arrow 16 at the bottom). Therefore, the left pile of FIG. 1A is functioning only as an end-bearing pile extending through sand 15, soft clay 17 onto a rock substrate 19, and the right pile of FIG. 1B is functioning as both an end-bearing pile bearing onto a sand substrate 16 and frictional pile held in place along an outer surface by friction between the pile 20 extending through surface sand 15, clay 17, onto the sand 16.

FIG. 2 shows a pile 27 which relies on friction 31 to transmit loading 30. The frictional resistance is indicated by the vertical black arrows 31 along the sides of the pile 27. The friction both prevents the pile from pushing into the soil 29 (i.e. prevents settlement) as well as transmits vertical loading to the soil. This loading type is used by many pile types, with an increased usage in driven piles as the force of driving the pile helps to increase compressive loading on the exterior of the pile.

A need exists for a method of constructing piles of new materials to take advantage of a wide range of structural properties in construction.

SUMMARY

Part of the innovation proposed is using glass as a material for construction of structural piling foundations. As mentioned above, glass greatly exceeds existing materials for construction piles, such as in strength. Through experimentation, it has been discovered that glasses can be melted by using electrical arcs (high amperage, low voltage) by exposing the glass to the radiant heat produced by the arc. This is different than the traditional method of melting glass using combustible gasses. It has been proven that glass cast using arcs can utilize fluxing materials to reduce the melting temperature. As glasses cast using arcs can also receive the effects of the reduction in melting temperatures, the costs of glass as a piling material can be made further economical as compared to concrete, especially when considering the increased strength of glass.

By casting glasses in a bore hole, the soil surrounding the bore hole naturally form an insulative barrier, which helps to maintain heat in the system and reduces moisture content in the soil surrounding the glass.

Another primary concern with piling type foundations is the friction produced on the exterior of a bore hole. It has been found through preliminary experimentation that the exterior of the steel casing partially melts and absorbs nearby soil, creating a rough surface on the exterior. This rough surface should have increased friction, increasing the pile's effective strength.

Another advantage is that glass piles can be considered a green material. If soil is taken from bore holes and recycled as a building material by making it into glass, material can be directly used from site. This would also help in cases were an excess of soil must be removed from the construction site. In comparison to concrete, steel, or timber piles, the costs reflect the transportation costs of these materials through their manufacturing processes and to the construction site. All these transportation costs are negated by using soils from the site.

In one embodiment, a system for forming a molten glass filled pile 575 includes a hollow casing 650, a control assembly 640 positioned proximately to the hollow casing, and a pivoting support device 649 connected to the control assembly. A pivoting electrode 675A is connected to the pivoting support device and configured to extend into the hollow casing, wherein the pivoting electrode has a range of motion defined by the hollow casing. A second electrode 675B is connected to the control assembly and configured to extend into the hollow casing within the range of motion of the pivoting electrode 675A. An electric power source 647 is connected to the pivoting electrode and the second electrode, wherein charge on the electrodes produces a current arc 669 between the pivoting electrode and the second electrode. A lift mechanism 605 is connected to a raising and lowering shaft 691 and the lifting/lowering assembly is positioned proximately to the hollow casing to control the electrodes' position within the hollow casing, i.e., a hollow steel sleeve.

A method of producing a piling employs steps that allow for a glass filler 500 in the field where a hollow casing 650 has been placed in a soil substrate. As noted above, the method includes positioning a pair of electrodes inside of a hollow casing, connecting the electrodes to a power source and inducing a charge on at least one of the electrodes. Moving at least one of the electrodes toward the other electrode within the hollow casing allows the the charge to initiate an arc of conduction between the pair of electrodes. Exposing glass forming materials to the heat of the arc within the hollow casing allows for forming a glass filler within the hollow casing, often from the bottom (distal end) up toward the surface and steel cap 608. In other words the lifting apparatus described above pulls the electrodes up and out of the glass filler as the glass is formed in a molten state that cools into glass. The hollow casing is not necessarily insulated if heating an environmental material such as sand or soil is desired for melting materials outside the hollow sleeve.

BRIEF DESCRIPTION OF THE DRAWINGS

The accompanying drawings, which are in and constitute a part of this specification, illustrate certain examples of the present disclosure and together with the description, serve to explain, without limitation, the principles of the disclosure. Like numbers represent the same element(s) throughout the figures. One source of the FIGS. 1A and 1B below is https://www.slideshare.net/G.

DETAILED DESCRIPTION

The following description of the disclosure is provided as an enabling teaching of the disclosure in its best, currently known embodiment(s). To this end, those skilled in the relevant art will recognize and appreciate that many changes can be made to the various embodiments of the invention described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

Through experimentation conducted and summarized herein, it was determined that glass filler 500 could be produced by using two graphite electrodes 675A, 675B connected to a high amperage (~200 Amps), low voltage (~24 Volts) electric power source 647. This discovery led to researching the strengths of glasses compared to other materials. Upon discovering the key advantages of glass (namely, the excessive compressive strength in pure compression), it was assumed that glass could be cast underground in a steel sleeve and serve as a glass filled pile for load support in construction applications.

Several other discoveries have been determined. Namely, using a fluxing (such as sodium carbonate, also known as washing soda), the glass melting temperature can be reduced, increasing the advantages of glass and glass fillers 500 in pile formation.

Figure 4:
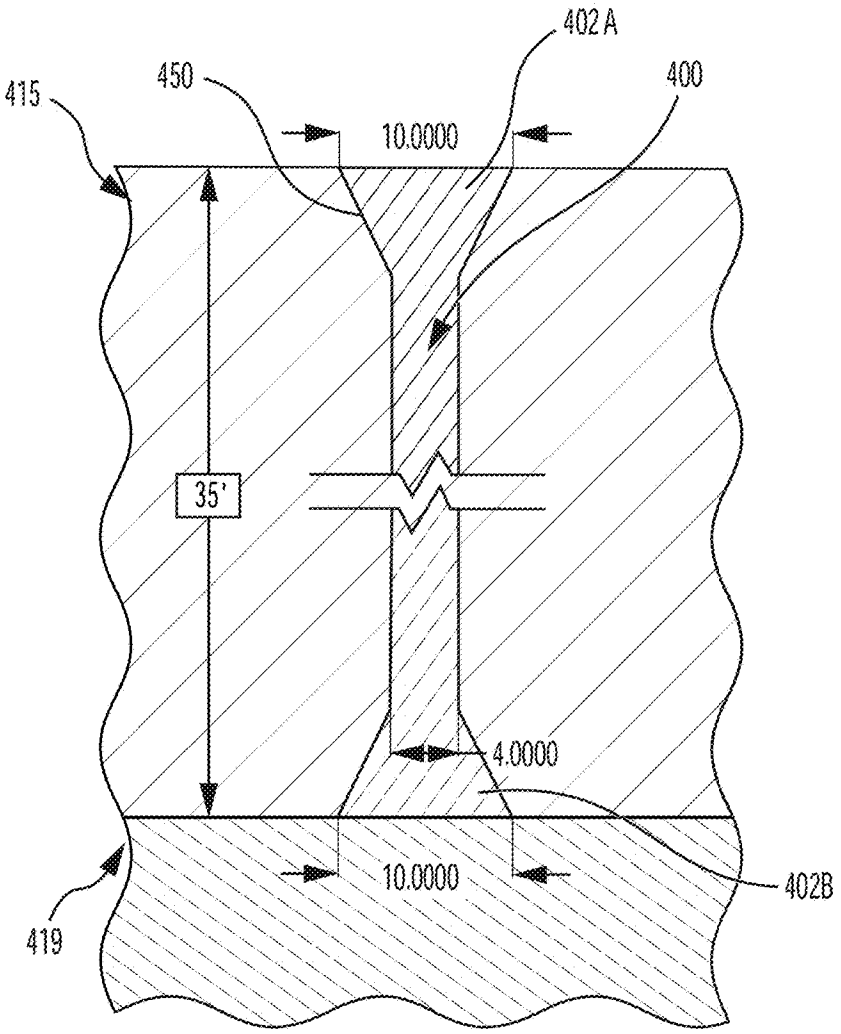
FIG. 4 is schematic representation of a pedestal type of pile.

By placing a series of electrodes 675A, 675B underground, connected through a melting head (referred herein as control assembly 640), which features an actuator mechanism 642 to push the electrodes 675A, 675B together, starting an electrical conduction arc 669 between the electrodes, and a feeding mechanism, such as a feed screw 644 and feed screw motor 670, it was determined that a mechanism could be created that would allow for continuous casting of soda-lime glass equivalent. This material could then be cast continuously while lifting the melting head/control assembly 640. Once the appropriate height was reached, the entire glass forming mechanism 600 could be removed from the molten glass filled pile 575. As the top layer of glass remains molten for an extended period after removing the melting head/control assembly 640, the cap 450 could then have steel reinforcement rods placed into the molten glass. This would then act as a capped pile in which load could be transmitted from the structure above to the glass pile 400, 500. The resulting capped pile as shown in FIG. 4 could then be constructed in contact with concrete using other traditional foundational elements.

With the above summary of the glass filled pile discussed herein, one can note many advantages to using the glass filled piles, particularly in the cost comparison of Table 1.

TABLE 1

Cost comparison between driven steel piles and arc melted glass.

| Foundation Type | Material | Material Cost Per Foundation |
|---|---|---|
| Steel Driven Piles | Steel | $8,139 |
| Arc Melted Glass Cylinder | Soda Lime Glass | $1,424 |
| Arc Melted Glass Pedestal | Soda Lime Glass | $290 |

Glass formations, therefore, present new, innovative material exhibiting increased strength above all other materials listed in Table 1. This is true even for steel; 150 ksi glass vs. 58 ksi steel. Glass also presents a lower costs than above materials on a cost per strength basis (0.88 cents/ksi concrete vs. 0.64 cents/ksi steel vs. 0.08 cents/ksi glass). Using glass as a filler material in pile construction is not time sensitive; glass can be cast when needed on site with no wait times or risk of delays.

In certain non-limiting embodiments, a few key components of glass filled pile systems will be required to be small, mechanized systems which must withstand temperatures between 400 and 600 deg. C. As glass filler becomes more prevalent, costs associated with components withstanding these conditions will be manageable.

Another key technical challenge has involved the strength of the resulting glass. While strengths of glasses are referenced as being substantial (greater than 1000 MPa in pure compression), none of these glasses have been manufactured through the same process, which is a bulk process for producing large quantities of low quality glass.

Casting in deeply restrictive environments could prove difficult. One major concern is a consistent method of controlling and measuring the casting process. Two possible measurable data points providing information during a glass casting process are voltage and current used to induce the electric art that melts materials and forms glass. It may prove to be necessary to include a temperature probe to verify that the glass is being cast at an appropriate temperature.

Casting below the water table of a river or other body of water is also possible using glass filled piles to support construction. Use of a bottom cap 402B is possible, and it has been found that partially saturated soil has shown no negative impacts. Casting glass onto fully saturated soil may be possible as well.

As mentioned previously, this disclosure includes one non-limiting example of a method of casting glass inside a borehole using graphite electrodes producing an electrical arc. There are several key points that illustrate the significance of this discovery:

i. Avoidance of combustible gases for the production of glass (they would not work correctly in a restricted air flow environment, such as a bore hole)
ii. Strengths of glasses exceed concrete
iii. On the basis of cost per strength, glass is a less expensive material than concrete
iv. Glasses can be utilized exclusively compressive in piling type foundations The bore hole itself acts as a furnace, slowly cooling the glass, preventing cracking.

TABLE 2

This table indicates the energy costs of several glasses.

| Material | Specific Heat (J/kg*deg. C.) | Softening Point (deg. C.) | Total Energy to Melt 1 kg (kW-hr) | Density (g/cc) | Practical Energy Req. for 1 kg (kW-hr) | Practical Energy Cost for 1 lb | Practical Material Cost for 1 lb |
|---|---|---|---|---|---|---|---|
| Pure Silica | 830 | 1683 | 0.426 | 2.2 | 1.419 | $0.19 | $0.19 |
| Soda Lime | 880 | 715 | 0.212 | 2.5 | 0.707 | $0.10 | $0.15 |
| Borosilicate Glass | 830 | 815 | 0.225 | 2.23 | 0.752 | $0.10 | $0.48 |
| Aluminosilicate Glass | 840 | 910 | 0.250 | 2.63 | 0.833 | $0.11 | $0.35 |

Table 2 above indicates the theoretical energy costs of several glass types. While borosilicate and soda-lime glasses have similar practical energy costs, borosilicate glass requires addition of materials (e.g. boric acid), which increase the cost far beyond soda-lime glass. Additionally, while pure silica has a lower practical material cost, it also requires producing very high temperatures to create the glass.

Figure 3:
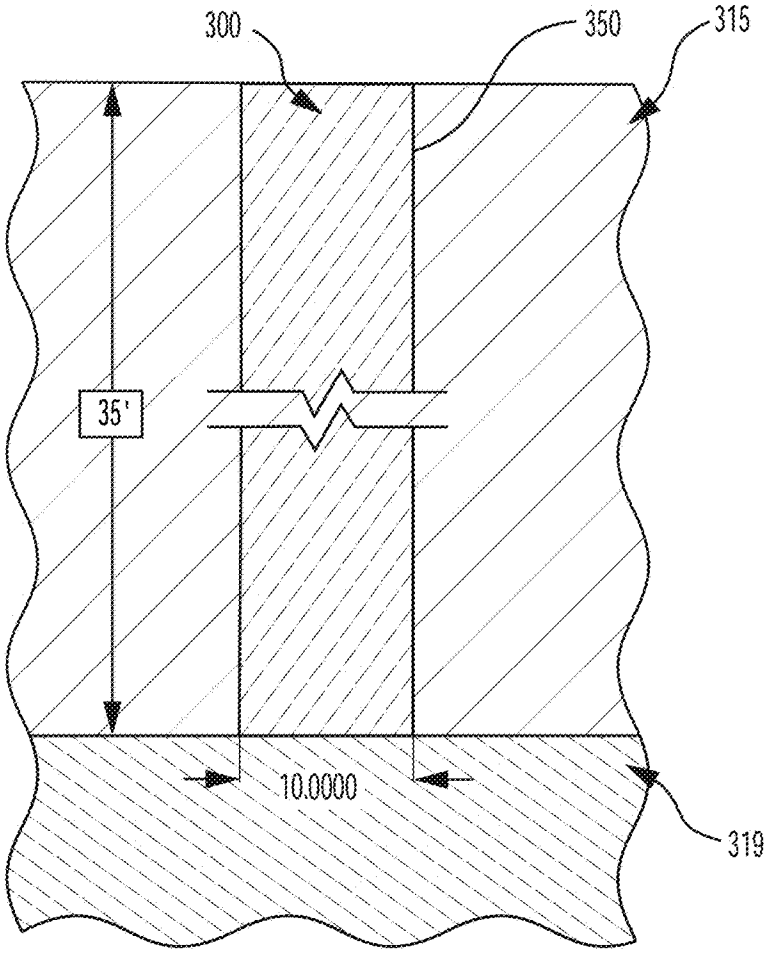
FIG. 3 is a schematic representation of a normal piling with typical ends.

To express why glass makes a better pile material more clearly, a comparison of a glass to a steel piling is shown below in a design example. For simplicity, the example uses a condition in which an end-bearing pile of FIG. 3 is being created. In Table 3, as with previous estimates, the cost of soda lime glass assumes a melting temperature of 750 deg. C., a 30% thermal efficiency, and 50.30 per kw-hr. The cost of steel was found online at agmetalminer.com.

TABLE 3

| Foundation Type | Material | Total Area Per Foundation (sq. in.) | Total Pile Length (in) | Total Volume (cu. In.) | S.G. | Total Weight (lbs) | Material Cost Per Lb | Material Cost Per Foundation |
|---|---|---|---|---|---|---|---|---|
| Steel Driven Piles | Steel | 186 | 420 | 78120 | 7.8 | 21997 | $0.37 | $8,139 |
| Arc Melted Glass Cylinder | Soda Lime Glass | 314 | 420 | 131880 | 2.5 | 11902 | $0.12 | $1,424 |
| Arc Melted Glass Pedestal | Soda Lime Glass | 48.8 | 420 | 26860.8 | 2.5 | 2424 | $0.12 | $290 |

In Table 3, the example's requirements required reaching a rock substrate below at 420 inches. The S.G. column represents the specific gravity, which dictates the weight of the material. The volume results from the pile length and the pile surface area, which is derived from the strength requirements. The material cost per unit weight is derived from a previous example which utilized the melting temperature of soda-lime glass and the heat of fusion. Assuming a 30% efficiency and $0.30 per kw-hr, the cost per unit weight of glass was found to be %0.12 per pound.

To explain the non-limiting example above, a required foundational pile strength of 530 tons is set as a test point. The rock substrate itself dictated design. The steel piles used utilized a cap as shown in FIG. 4, increasing the bearing area against the rock substrate. Despite this, the cost of soda-lime glass was determined to be less.

In the above example, glasses easily exceed the strength of steel as the failure strength of glass in compression is 1000 MPa (as compared to 400 MPa with steel; these values are from the diim.unict.it website). Additionally, steel has a relatively high cost when compared to glass produced on a construction site with the innovation outlined in this report.

Additionally, the above example includes a foundation type referred to as a "glass pedestal 300." This type of foundation is shown in FIG. 3. This would be an idealized foundation in which the bottom and top of a glass pile could be enlarged as shown in FIG. 4 by increasing the heat generated at the top and bottom of a steel casing, causing respective large balls of soil 315 to melt at these locations and form a top cap 402A for connecting the load to a substrate, such as rock layer 319 via a bottom cap 402B. By doing so, glass can be found to be even more competitive as current designs restrict glass usage due to the strengths of the soils in which loads are being transferred. Essentially, the glass pile 400 of FIG. 4 only needs an increased thickness at the bottom of the pile if transferring to a rock layer 419 below as the glass is theoretically stronger than what a typical allowable load is for a rock formation 415.

FIGS. 3-6 show images of a proof of concept glass pile that has been produced. In one non-limiting example, the method for creating this small section of pile was by melting small portions of sand-soda ash mixture inside of a steel sleeve 350, 450, 550 (i.e., a hollow casing 650) was selected as they a readily available.

The procedure of one non-limiting test was to connect the two graphite electrodes 675A, 675B to the positive and negative terminals of an electric power source 647. The electric power source 647. was set to 200 amps at 24 volts. The ends 681A, 681B, 682A, 682B of the graphite electrodes were lowered into the bottom of the hollow casing 650. Similar to welding, an arc 669 was created by moving the two electrodes together, then holding them about 0.5 inches apart. This arc was used to melt the sand-soda ash mixture, which about two cubic inches of mixture was added every 10 seconds of arcing.

Figure 1B:
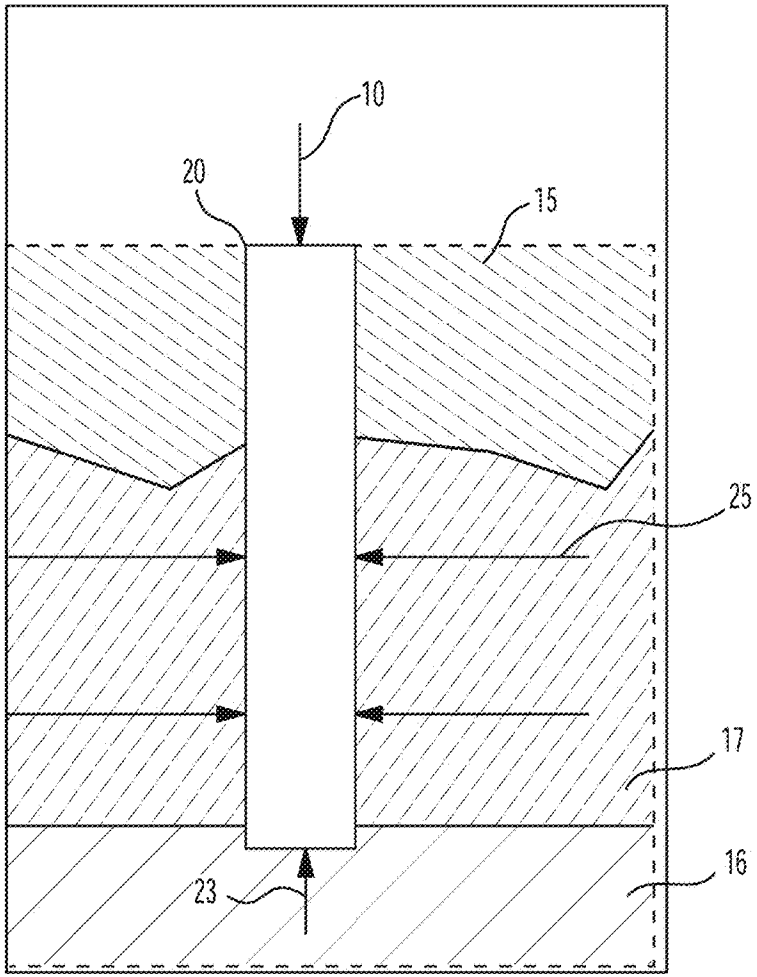
FIG. 1B PRIOR ART
FIG. 1B is a PRIOR ART schematic representation of a combination end-bearing/frictional pile as disclosed herein.
Figure 1A:
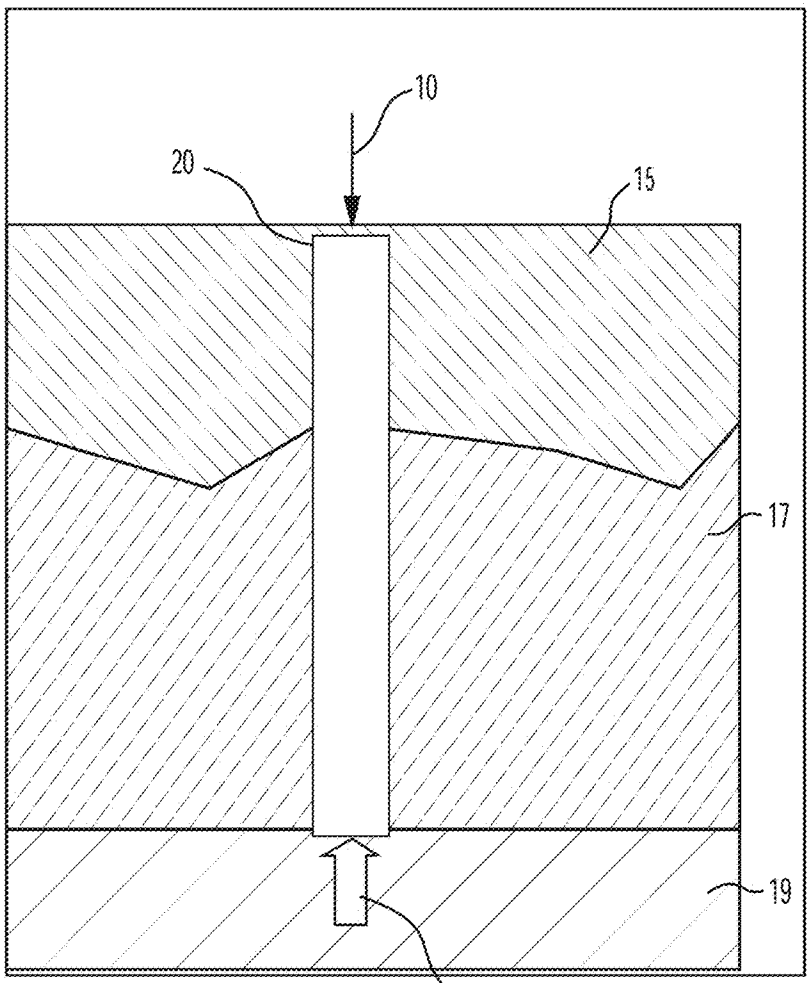
FIG. 1A PRIOR ART
FIG. 1A is a PRIOR ART schematic representation of an end-bearing pile as disclosed herein.
Figure 2:
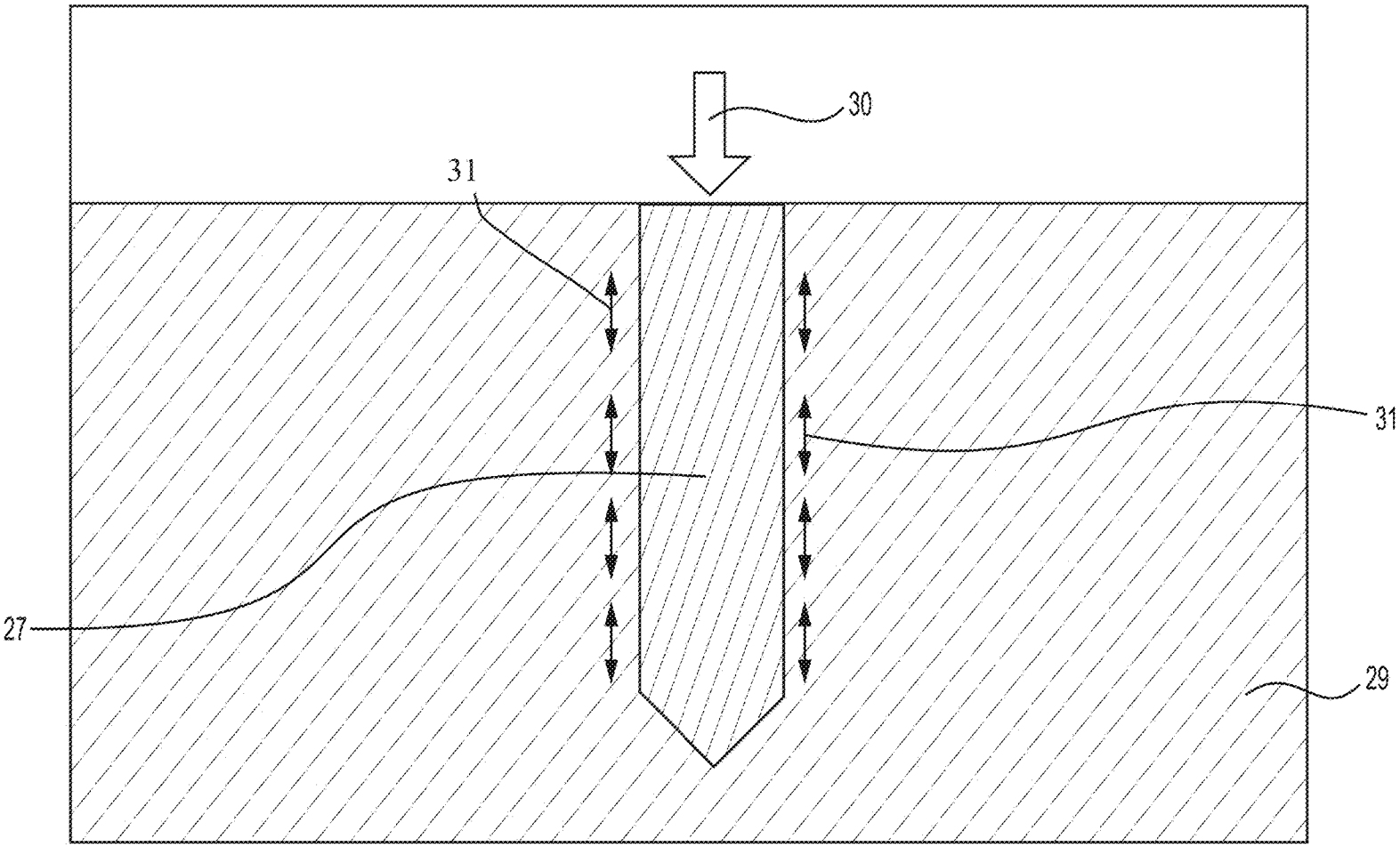
FIG. 2 is a PRIOR ART schematic representation of a frictional pile as disclosed herein.
Figure 5A:
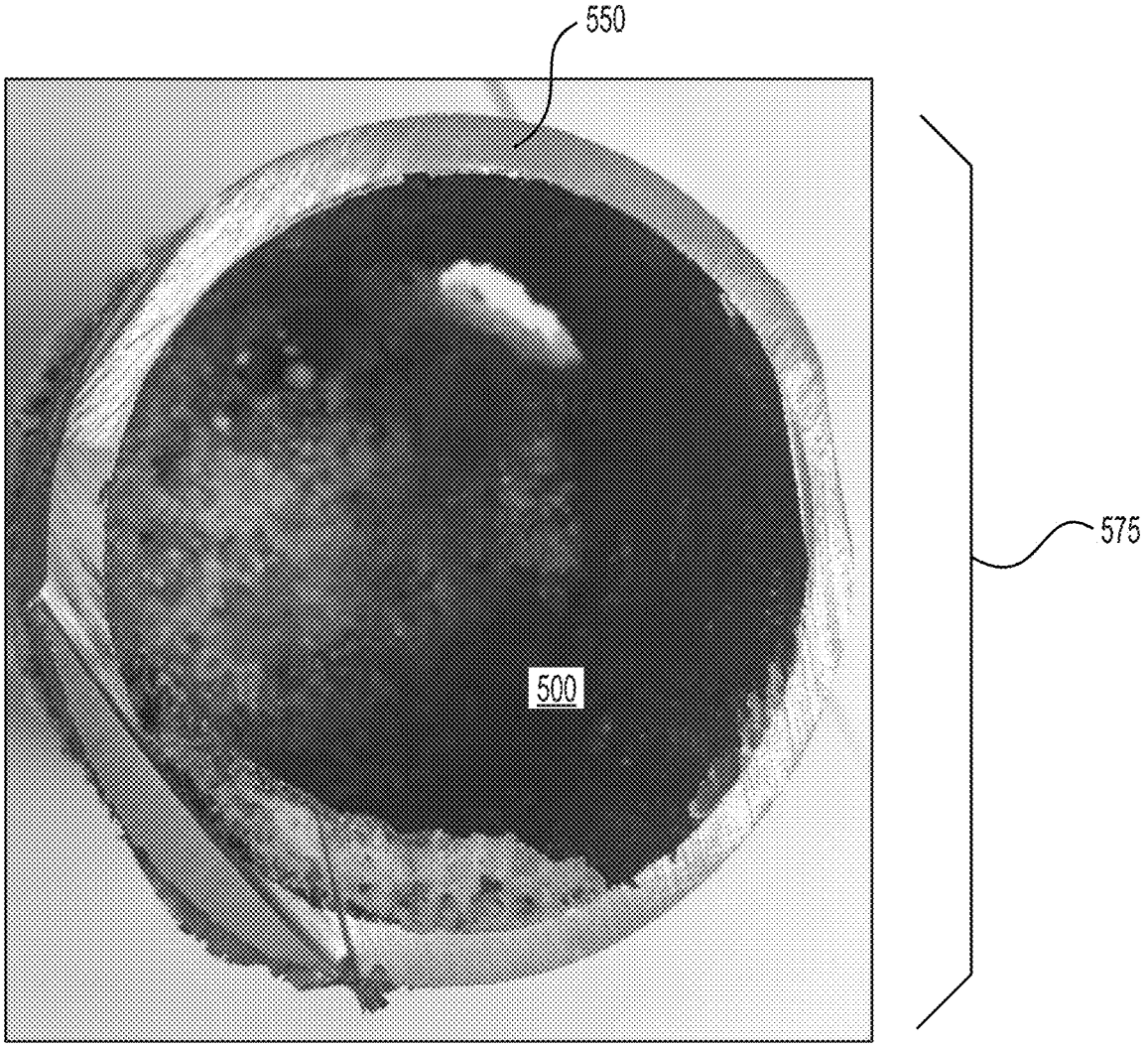
FIG. 5A is a top plan view of a hollow casing having a glass filler and forming a pile as described herein.
Figure 5B:
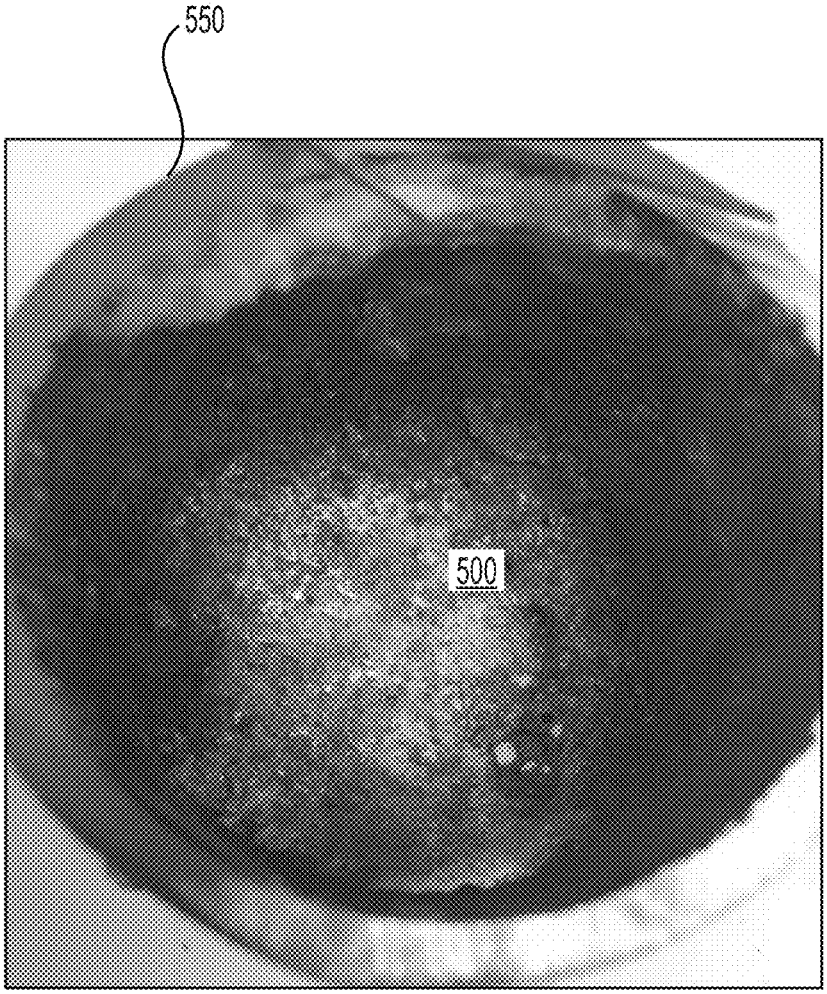
FIG. 5B is a top plan view of a hollow casing having a glass filler and forming a pile as described herein.
Figure 5C:
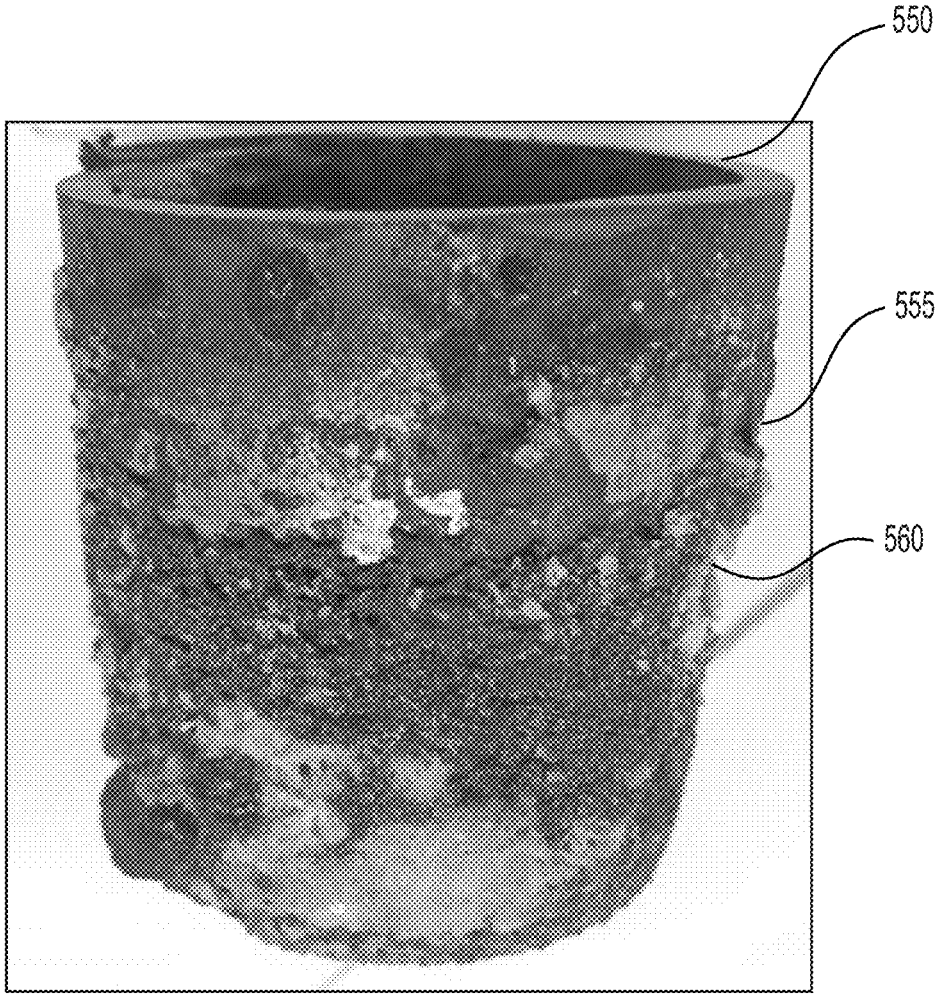
FIG. 5C is a side perspective view of a glass filled pile as disclosed herein.

After creating a small portion of glass, the steel sleeve 550 was cut to allow for easier viewing of the glass as shown in FIGS. 5A, 5B, 5C. Note that the exterior 555 of the hollow sleeve 550 (e.g., steel casing) shown in FIG. 5C shows the rough exterior 560. As the sand exterior to the hollow sleeve 550 began melting, it imbedded into the exterior 555 of the steel hollow sleeve 550. This melted finish forming the rough exterior 560 should increase frictional resistance when used in a full-scale pile. This will help with design of such piles as the pile should be able to function as a frictional pile, as indicated in FIGS. 1B and 2.

Figures 6A, 6B, 6C:
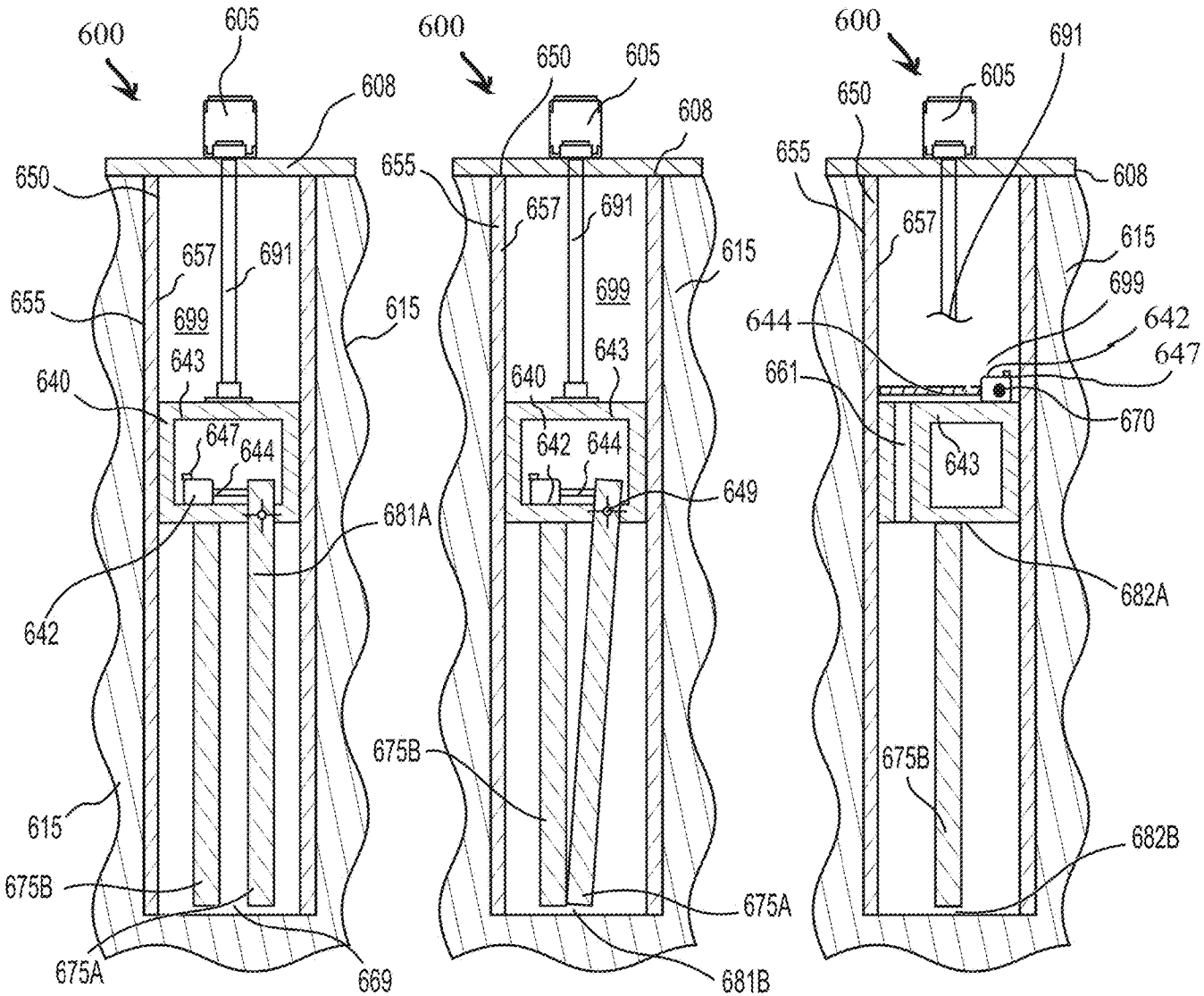
FIG. 6A is a plan view of a cross section of a hollow casing for arc welding a glass filled pile as disclosed herein.
FIG. 6B is a plan view of a cross section of a plan view of a cross section of a hollow casing with pivoting electrodes for arc welding a glass filled pile as disclosed herein.
FIG. 6C is a plan view of a cross section of a hollow casing for arc welding a glass filled pile as disclosed herein.

An example prototype has been laid out in FIGS. 6A, 6B, and 6C. This prototype of a glass filled pile mechanism 600 includes a mechanized feed system with a mechanical actuator 642 for contacting the graphite electrodes 675A, 675B, and an electrical controller (including computer implement control systems in computerized hardware) that determines the sequencing of all motors for casting the sand as a glass in the hollow casing 650. Noting that a controlled process allows for feeding glass forming materials into an interior 699 of a hollow casing 650, the glass forming materials may include but are not limited to silica, sand, fluxing materials, sodium carbonate, calcium oxide, magnesium oxide, aluminum oxide, iron oxide, and boron oxide.

In one embodiment, a system for forming a molten glass filled pile 575 includes a hollow casing 650, a control assembly 640 positioned proximately to the hollow casing, and a pivoting support device 649 connected to the control assembly. A pivoting electrode 675A is connected to the pivoting support device and configured to extend into the hollow casing, wherein the pivoting electrode has a range of motion defined by the hollow casing. A second electrode 675B is connected to the control assembly and configured to extend into the hollow casing within the range of motion of the pivoting electrode 675A. An electric power source 647 is connected to the pivoting electrode and the second electrode, wherein charge on the electrodes produces a current arc 669 between the pivoting electrode and the second electrode. A lift mechanism 605 is connected to a raising and lowering shaft 691 and the lifting/lowering assembly is positioned proximately to the hollow casing to control the electrodes' position within the hollow casing, i.e., a hollow steel sleeve. The lifting and lowering mechanism is configured to move the pivoting electrode and the second electrode along an interior of the hollow casing. In other words, the lifting and lowering assembly (including lead screw and shaft) are connected to a control assembly 640 so that the arc-forming electrodes 675A, 675B can move freely within the hollow casing 650. In one non-limiting embodiment, the hollow casing comprises a steel sleeve that conducts heat from the current arc. In this way, the heat emanating from the hollow casing 650 is positioned to melt soil or sand exterior 615 to the hollow casing 650, forming the rough surface 655 as described above. The control assembly 640 includes an insulating enclosure 643 surrounding the electric power source 642 and/or a pivoting support device 649 and/or at least one actuator 642 engaging the pivoting support device 649 to move the pivoting electrode 675A toward the second electrode 675B and induce the electrical current arc 669 between the electrodes. A system as described in this disclosure may configure the insulating enclosure 643 to be so dimensioned to traverse the interior 699 of the hollow casing 650 as the lift mechanism 605, 691 moves the pivoting electrode and the second electrode. As shown in FIG. 6B, the range of motion of the pivoting electrode is sufficient to move the pivoting electrode to a position contacting the second electrode. The control assembly 640 fits within the hollow casing with the insulating enclosure extending alongside an interior surface 657 of the hollow casing, and the insulating enclosure defines a drop slot 661 illustrated in FIG. 6C for directing raw materials into the hollow casing and toward respective distal ends 681B, 682B of the pivoting electrode and the second electrode. A pushing mechanism such as a feed screw 644 moves the raw materials from an open end of the hollow casing into the drop slot. The raw materials traverse the hollow casing toward a respective distal end 681B, 682B of the pivoting electrode and the second electrode. The open end of the hollow casing may be covered with a base plate 608 in some embodiments. The electrodes are made of a material selected from the group consisting of tungsten, tungsten-copper alloys, graphite, graphite alloys, and other conductive metal alloys.

A method of producing a piling employs steps that allow for a glass filler 500 in the field where a hollow casing 650 has been placed in a soil substrate. As noted above, the method includes positioning a pair of electrodes inside of a hollow casing, connecting the electrodes to a power source and inducing a charge on at least one of the electrodes. Moving at least one of the electrodes toward the other electrode within the hollow casing allows the the charge to initiate an arc of conduction between the pair of electrodes. Exposing glass forming materials to the heat of the arc within the hollow casing allows for forming a glass filler within the hollow casing, often from the bottom (distal end) up toward the surface and steel cap 608. In other words the lifting apparatus described above pulls the electrodes up and out of the glass filler as the glass is formed in a molten state that cools into glass. The hollow casing is not necessarily insulated if heating an environmental material such as sand or soil is desired for melting materials outside the hollow casing 650.

Positioning the hollow casing underground with the exterior environment being soil allows for glass filled piles to be formed for bearing a load thereon as discussed above. Lifting the electrodes from a first end of the hollow casing cause distal ends of the electrodes to move from an opposite end of the hollow casing toward the first end of the hollow casing, forming the glass filler with the pair of electrodes as the pair of electrodes moves from the opposite end toward the first end of the hollow casing. As noted above, the method of this disclosure optionally includes forming a glass cap in the exterior environment, wherein the glass cap connects to the hollow casing and the glass filler in the hollow casing by melting soil in the exterior environment below the opposite end of the hollow casing.

Operating parameters for forming the glass filler optionally include operating the power source within a range of 190-210 amps at a voltage within a range of 20-30 volts. In one non-limiting embodiment, applying the power source at about 200 amps at about 24 volts forms a desirably strong glass filler.

Terminology

Unless defined otherwise, all technical and scientific terms used herein have the same meaning as commonly understood to one of ordinary skill in the art to which this invention belongs.

As used in the specification and claims, the singular form "a," "an," and "the" include plural references unless the context clearly dictates otherwise. For example, the term "an agent" includes a plurality of agents, including mixtures thereof.

As used herein, the terms "can," "may," "optionally," "can optionally," and "may optionally" are used interchangeably and are meant to include cases in which the condition occurs as well as cases in which the condition does not occur. Thus, for example, the statement that a formulation "may include an excipient" is meant to include cases in which the formulation includes an excipient as well as cases in which the formulation does not include an excipient.

Ranges can be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed.

Publications cited herein are hereby specifically by reference in their entireties and at least for the material for which they are cited.

Although the present disclosure has been described in detail with reference to particular arrangements and configurations, these example configurations and arrangements may be changed significantly without departing from the scope of the present disclosure. For example, although the present disclosure has been described with reference to particular communication exchanges involving certain network access and protocols, network device 102 may be applicable in other exchanges or routing protocols. Moreover, although network device 102 has been illustrated with reference to particular elements and operations that facilitate the communication process, these elements, and operations may be replaced by any suitable architecture or process that achieves the intended functionality of network device 102.

Numerous other changes, substitutions, variations, alterations, and modifications may be ascertained to one skilled in the art and it is intended that the present disclosure encompass all such changes, substitutions, variations, alterations, and modifications as falling within the scope of the appended claims.

Note that in this Specification, references to various features (e.g., elements, structures, modules, components, steps, operations, characteristics, etc.) included in "one embodiment", "example embodiment", "an embodiment", "another embodiment", "some embodiments", "various embodiments", "other embodiments", "alternative embodiment", and the like are intended to mean that any such features are included in one or more embodiments of the present disclosure, but may or may not necessarily be combined in the same embodiments. Note also that an 'application' as used herein this Specification, can be inclusive of an executable file comprising instructions that can be understood and processed on a computer, and may further include library modules loaded during execution, object files, system files, hardware logic, software logic, or any other executable modules. In example implementations, at least some portions of the activities may be implemented in software provisioned on networking device. In some embodiments, one or more of these features may be implemented in hardware, provided external to these elements, or consolidated in any appropriate manner to achieve the intended functionality. The various network elements may include software (or reciprocating software) that can coordinate in order to achieve the operations as outlined herein. In still other embodiments, these elements may include any suitable algorithms, hardware, software, components, modules, interfaces, or objects that facilitate the operations thereof.

Furthermore, the computers referenced herein may also include suitable interfaces for receiving, transmitting, and/or otherwise communicating data or information in a network environment. Additionally, some of the processors and memory elements associated with the various nodes may be removed, or otherwise consolidated such that single processor and a single memory element are responsible for certain activities. In a general sense, the arrangements depicted in the Figures may be more logical in their representations, whereas a physical architecture may include various permutations, combinations, and/or hybrids of these elements. It is imperative to note that countless possible design configurations can be used to achieve the operational objectives outlined here. Accordingly, the associated infrastructure has a myriad of substitute arrangements, design choices, device possibilities, hardware configurations, software implementations, equipment options, etc.

In some of example embodiments, one or more memory elements can store data used for the operations described herein. This includes the memory being able to store instructions (e.g., software, logic, code, etc.) in non-transitory media, such that the instructions are executed to carry out the activities described in this Specification. A processor can execute any type of instructions associated with the data to achieve the operations detailed herein in this Specification. In one example, processors could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., a field programmable gate array (FPGA), an erasable programmable read only memory (EPROM), an electrically erasable programmable read only memory (EEPROM)), an ASIC that includes digital logic, software, code, electronic instructions, flash memory, optical disks, CD-ROMs, DVD ROMs, magnetic or optical cards, other types of machine-readable mediums suitable for storing electronic instructions, or any suitable combination thereof.

These devices may further keep information in any suitable type of non-transitory storage medium (e.g., random access memory (RAM), read only memory (ROM), field programmable gate array (FPGA), erasable programmable read only memory (EPROM), electrically erasable programmable ROM (EEPROM), etc.), software, hardware, or in any other suitable component, device, element, or object where appropriate and based on particular needs. Any of the memory items discussed herein should be construed as being encompassed within the broad term 'memory element. Similarly, any of the potential processing elements, modules, and machines described in this Specification should be construed as being encompassed within the broad term 'processor.

The list of network destinations can be mapped to physical network ports, virtual ports, or logical ports of the router, switches, or other network devices and, thus, the different sequences can be traversed from these physical network ports, virtual ports, or logical ports.

What is claimed is:

1. A system for forming a piling structure, comprising:

a hollow casing;

a control assembly positioned proximately to the hollow casing;

a pivoting support device connected to the control assembly;

a pivoting electrode connected to the pivoting support device and configured to extend into the hollow casing, wherein the pivoting electrode has a range of motion defined by the hollow casing;

a second electrode connected to the control assembly and configured to extend into the hollow casing and within the range of motion of the pivoting electrode;

an electric power source connected to the pivoting electrode and the second electrode, wherein charge on the electrodes produces a current arc between the pivoting electrode and the second electrode; and a lift mechanism positioned proximately to the hollow casing and configured to move the pivoting electrode and the second electrode along an interior of the hollow casing.

2. The system according to claim 1, wherein the hollow casing comprises a steel sleeve that conducts heat from the current arc.

3. The system according to claim 1, wherein the control assembly comprises an insulating enclosure surrounding the electric power source and/or the pivoting support device and/or at least one actuator engaging the pivoting support device to move the pivoting electrode toward the second electrode and induce the current arc.

4. The system according to claim 3, wherein the insulating enclosure is so dimensioned to traverse the interior of the hollow casing as the lift mechanism moves the pivoting electrode and the second electrode.

5. The system according to claim 1, wherein the range of motion of the pivoting electrode is sufficient to move the pivoting electrode to a position contacting the second electrode.

6. The system according to claim 1, wherein the control assembly comprises a computer having a processor and memory storing computerized software instructions to control the system.

7. The system according to claim 1, wherein the control assembly fits within the hollow casing with the insulating enclosure extending alongside an interior surface of the hollow casing, and wherein the insulating enclosure defines a drop slot for directing raw materials into the hollow casing and toward respective distal ends of the pivoting electrode and the second electrode.

8. The system according to claim 7, further comprising a pushing mechanism moving the raw materials from an open end of the hollow casing into the drop slot.

9. The system according to claim 8, wherein the pushing mechanism is a feed screw.

10. The system according to claim 1, wherein the electrodes are made of a material selected from the group consisting of tungsten, tungsten-copper alloys, graphite, graphite alloys, and other conductive metal alloys.

11. The system according to claim 1, further comprising raw materials traversing the hollow casing toward a respective distal end of the pivoting electrode and the second electrode.

12. The system according to claim 10, wherein the raw materials comprise glass forming components.

13. The system according to claim 11, wherein the glass forming components are selected from the group consisting of silica, sand, fluxing materials, sodium carbonate, calcium oxide, magnesium oxide, aluminum oxide, iron oxide, and boron oxide.

14. The system according to claim 1, further comprising an outer surface of the hollow casing conducting heat to an exterior substrate that melts onto the outer surface of the hollow casing.

15. The system according to claim 1, further comprising a temperature probe positioned proximately to a distal end of the electrodes and configured to transmit a temperature at which glass is forming within the hollow casing.

16. A method of producing a piling comprising:

positioning a pair of electrodes inside of a hollow casing;

connecting one of the electrodes to a pivoting support device as a pivoting electrode with a range of motion defined by the hollow casing;

connecting the electrodes to a power source and inducing a charge on at least one of the electrodes;

moving one of the electrodes toward the other electrode within the hollow casing such that the charge initiates an arc of conduction between the pair of electrodes;

exposing glass forming materials to heat from the arc within the hollow casing and forming a glass filler within the hollow casing;

moving the electrodes along an interior of the hollow casing such that the electrodes exit the hollow casing in a direction opposite the forming of the glass filler; and allowing the heat from the arc to conduct across the hollow casing to an exterior environment.

17. The method according to claim 16, further comprising positioning the hollow casing underground with the exterior environment being soil.

18. The method according to claim 17, further comprising melting the soil in the exterior environment onto an outer surface of the hollow casing.

19. The method according to claim 17, further comprising lifting the electrodes from a first end of the hollow casing such that respective distal ends move from an opposite end of the hollow casing toward the first end of the hollow casing.

20. The method according to claim 19, further comprising forming the glass filler with the pair of electrodes as the pair of electrodes moves from the opposite end toward the first end of the hollow casing.

21. The method according to claim 20, further comprising forming a glass cap in the exterior environment, wherein the glass cap connects to the hollow casing and the glass filler in the hollow casing by melting soil in the exterior environment below the opposite end of the hollow casing.

22. The method according to claim 16, further comprising adding the glass forming materials into the hollow casing as the electrodes move across an interior of the hollow casing and forming the glass filler therein.

* * * * *